US011629439B2

(12) United States Patent
Tannebaum

(10) Patent No.: US 11,629,439 B2
(45) Date of Patent: Apr. 18, 2023

(54) COMPRESSIVE KNITTED FABRIC WITH ADHESIVE EFFECT

(71) Applicant: MEDI GMBH & CO. KG, Bayreuth (DE)

(72) Inventor: Wolfgang Tannebaum, Weiden (DE)

(73) Assignee: MEDI GMBH & CO. KG, Bayreuth (DE)

( * ) Notice: Subject to any disclaimer, the term of this patent is extended or adjusted under 35 U.S.C. 154(b) by 176 days.

(21) Appl. No.: 16/837,936

(22) Filed: Apr. 1, 2020

(65) Prior Publication Data

US 2020/0347530 A1 Nov. 5, 2020

(30) Foreign Application Priority Data

May 3, 2019 (EP) ..... 19020321

(51) Int. Cl.
*D04B 1/26* (2006.01)
*A41B 11/00* (2006.01)

(52) U.S. Cl.
CPC ..... *D04B 1/26* (2013.01); *D04B 1/265* (2013.01); *A41B 11/00* (2013.01); *A41B 2400/80* (2013.01); *A41B 2500/10* (2013.01); *D10B 2501/021* (2013.01)

(58) Field of Classification Search
USPC ..... 66/185
See application file for complete search history.

(56) References Cited

U.S. PATENT DOCUMENTS 1,769,856 A * 7/1930 Page ..... D04B 15/34 66/182
1,974,993 A * 9/1934 Nebel ..... D04B 1/26 66/185
2,370,450 A * 2/1945 Clarke ..... D04B 1/26 66/185
3,793,851 A * 2/1974 Thorneburg ..... D04B 1/02 66/185
3,905,212 A * 9/1975 Bounous ..... D04B 1/265 66/185
4,149,274 A 4/1979 Garrou et al.
4,194,249 A * 3/1980 Thorneburg ..... D04B 1/02 2/239
4,237,707 A * 12/1980 Safrit ..... D04B 1/18 66/172 E
4,373,361 A * 2/1983 Thorneburg ..... D04B 1/02 66/178 R (Continued)

FOREIGN PATENT DOCUMENTS

CN 104260538 A * 1/2015
EP 2886691 B1 7/2018

(Continued)

*Primary Examiner* — Khoa D Huynh
*Assistant Examiner* — Grace Huang
(74) *Attorney, Agent, or Firm* — Rimon Law PC

(57) ABSTRACT

The invention relates to a compressive knitted fabric consisting of at least one stitch-forming basic knitting thread, at least one inserted and/or knitted elastic weft thread and at least one plush thread plaited, at least partially, onto the basic knitting thread and forming plush loops, wherein the at least one plush thread is an adhesive thread in order to give the compressive knitted fabric an anti-slip effect.

16 Claims, 2 Drawing Sheets

(56) References Cited

Figure 1:
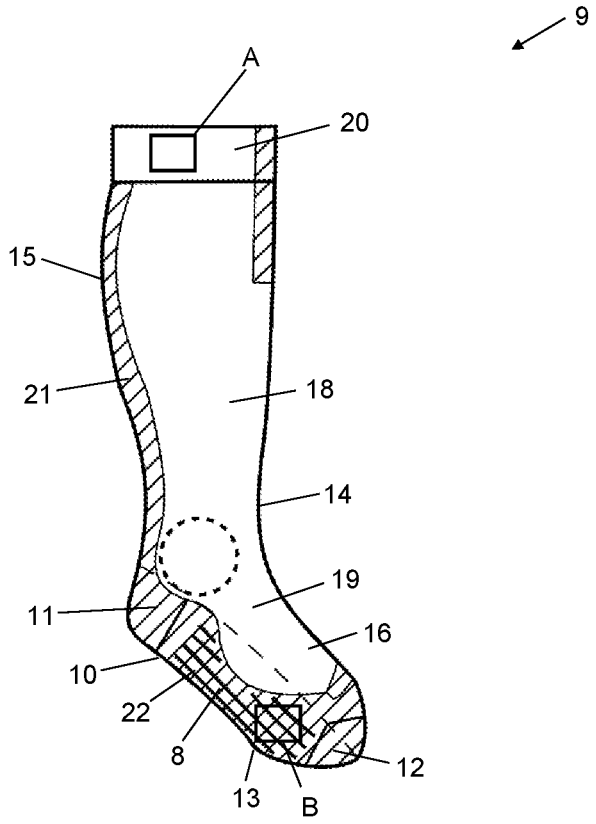

U.S. PATENT DOCUMENTS 4,397,161 A * 8/1983 Chesebro, Jr. ..... A41B 11/00 66/178 A
4,520,635 A * 6/1985 Shields ..... A41B 11/02 2/239
4,522,044 A * 6/1985 Lineberry ..... A41B 11/02 66/185
4,527,403 A * 7/1985 Fullbright ..... A41B 9/001 2/401
4,732,015 A * 3/1988 Abrams ..... D04B 1/102 66/172 E
4,748,078 A * 5/1988 Doi ..... D04B 21/12 442/312
5,095,548 A * 3/1992 Chesebro, Jr. ..... D04B 1/04 2/239
5,307,522 A * 5/1994 Throneburg ..... A41B 11/00 2/239
5,335,517 A * 8/1994 Throneburg ..... A41B 11/00 2/239
5,708,985 A 1/1998 Ogden
6,230,525 B1 * 5/2001 Dunlap ..... D04B 1/26 66/178 R
6,289,701 B1 * 9/2001 Hasenack ..... D02G 3/324 66/171
7,441,419 B1 * 10/2008 Dollyhite ..... A61F 13/08 66/178 A
7,552,603 B2 * 6/2009 Dahlgren ..... A41B 11/00 2/239
7,682,994 B2 * 3/2010 Van Emden ..... D03D 15/00 442/181
8,250,676 B2 * 8/2012 Ramsey ..... A41B 11/005 2/239
8,308,817 B2 * 11/2012 Egilsson ..... A61L 27/56 623/36
8,424,118 B2 * 4/2013 Maxey ..... D04B 1/18 2/400
8,959,666 B2 * 2/2015 Black ..... A41B 9/00 2/406
8,973,411 B2 * 3/2015 Gaither ..... A61F 13/08 66/182
10,724,157 B2 * 7/2020 Zorn ..... D04B 1/18
10,779,586 B2 * 9/2020 Langer ..... A41D 1/08
2006/0144097 A1 * 7/2006 Langer ..... D04B 1/26 66/178 R
2006/0148356 A1 * 7/2006 Zhang ..... D06M 13/432 442/310
2008/0128044 A1 * 6/2008 Barak ..... D06M 23/12 139/383 R
2009/0240279 A1 * 9/2009 Becker ..... A61F 13/08 606/201
2015/0038040 A1 * 2/2015 Gabbay ..... D04B 1/16 442/189
2016/0076175 A1 * 3/2016 Rock ..... A61F 13/08 66/171

FOREIGN PATENT DOCUMENTS

FR 2929506 A1 * 10/2009 ..... A61F 13/08
GB 545153 A * 5/1942 ..... D04B 1/26
WO 2005063062 A1 7/2005
WO 2012030873 A2 3/2012

* cited by examiner

COMPRESSIVE KNITTED FABRIC WITH ADHESIVE EFFECT

CROSS-REFERENCE TO RELATED APPLICATIONS

This application claims priority to European Patent Application serial number 19020321.6, filed May 3, 2019, the contents of each of which are incorporated herein by reference in their entirety.

BACKGROUND OF THE INVENTION

The present invention relates to a knitted fabric, in particular to a compressive knitted fabric with an adhesive effect.

Such knitted fabrics are used in particular to form leg garments, for medical use and/or for application in sporting activities. These compressive garments are used to apply pressure to the body of a patient in a targeted manner. The pressure applied to the body of a patient is designated as compression. The aim of compression stockings, for example, in particular in the form of leg wear with or without a hand or foot part for medical use is inter alia to remove pressure from a damaged vein and/or lymph system of a patient. As a result of the supplied pressure, an increasing swelling of the limbs is avoided, the removal of venous blood and lymph is improved and the blood supply is increased. When compression stockings are used in the sports area, these bring about an increase in performance or an improved regeneration.

In order to form compressive knitted fabrics, these are preferably flat- or round-knitted by means of a circular knitting machine or a flat knitting machine having a front and a rear needle bed. For this purpose the knitted fabrics are knitted from at least one stitch-forming knitting thread and an inserted elastic weft thread. The standard RAL-GZ 387 of the Quality Mark Association exists for the manufacture, in particular for the measurement and quality assurance of compressive arm or leg stockings for medical application. From the test specifications of the RAL it can be determined how the pressure of a compressive stocking on the leg is to be determined. Testing on the HOSY measuring device (Hohenstein Institute) is proposed as measurement means, in particular compression testing device. The testing is carried out by measuring the tension at the plurality of measurement points which varies depending on the respective stretchability of the knitted fabric, i.e. depending on the elasticity of the knitted fabric. The compression is calculated from the tension. That is, the more elasticity a knitted fabric has in the transverse direction of the knitted fabric, the lower the compression applied to the patient by the knitted fabric. On the other hand, the lower the elasticity of the knitted part, the higher is the compression applied to the patient.

A plurality of compressive knitted fabrics, in particular in the form of arm or leg stockings, are known from the prior art. A textile fabric having an anti-slip effect, in particular for use in bandages or compression stockings, is known, for example, from EP 2 886 691 B1.

This known textile fabric, which is a flat knit produced on two sets of needles, is produced by two thread systems which are interconnected by forming stitches with a stitch head and two stitch shanks leading to the stick head. An anti-slip effect is imparted to the fabric by knitting a silicone thread into the textile fabric in a stitch-forming manner, namely in the manner that the silicone thread forms basic knitting stitches and thus is substantially only exposed in the area of its stitch shanks on the surface of the textile fabric. As a result, the silicone thread only appears in the area of the stitch shanks on the surface of the fabric or emerges from this. A predominant part of the silicon stitches lies inside the knitted fabric. With the solution known from the prior art, an anti-slip effect is thus imparted to the textile fabric.

The reduced adhesive effect proves to be a disadvantage of the configuration of the textile fabric known from this prior art. Since the adhesive silicone thread knitted into the textile fabric in a stitch-forming manner only emerges at the stitch shanks thereof on the knitted fabric surface, only very few adhesive sections are present on the fabric. The predominant part of the silicone thread, namely the stitch heads and stitch feet, is present in the interior of the knitted fabric, that is, neither on the inner side of the knitted fabric nor on the outer side of the knitted fabric. This fraction of the knitted-in silicone thread, in particular the stitches formed in each case, has no effect on the adhesive properties of the knitted fabric. On the contrary, this fraction reduces the breathability of the knitted fabric, which in turn can result in increased formation of perspiration on the wearer of the garment.

A further disadvantage of the textile fabric known from the prior art is the formation of the basic knitted fabric as a flat knit, in particular using the silicone thread to form basic knitting stitches. As a result of the formation of the fabric as a flat knit, in particular as a two-ply knitted fabric, the silicone thread only emerges at one surface of the textile fabric. An anti-slip effect is therefore only achieved on one side of the knitted fabric. For knitted fabrics or compressive garments on which, however, an anti-slip effect should be achieved on both sides of the fabric, this prior art does not yield any proposed solution.

Known from WO 2012/030873 A2 is a textile fabric, in particular a knitted fabric, which has an inner and an outer side on which adhesive sections are again provided in each case in order to simultaneously produce an adhesive effect between the wearer of the fabric and the fabric itself and between the fabric and an external surface. The adhesive sections are fabricated here by an adhesive and structured material. In addition to applying, in particular spraying on by means of a template or printing on, a plurality of adhesive sections, it is proposed to knit the entire textile fabric from a plurality of adhesive yarns, or to partially knit-in these yarns with adhesive properties, in particular to plait onto a basic knitted fabric, i.e. onto a basic knitting stitch. In order to produce adhesive sections on the inner and outer side, at least two adhesive yarns are used for this purpose which each appear only on one side.

A disadvantage of the textile fabric known from this prior art proves to be the knitting of several adhesive yarns to produce an adhesive effect on the inner and outer side. As a result of the use of several adhesive yarns, increased production times and production costs are incurred.

Furthermore, only an average adhesive effect is achieved due to the pure plaiting-on of the adhesive yarns. By plaiting the adhesive yarn onto a basic knitting thread, this is specifically only exposed at the stitch heads formed on the surface of the knitted fabric. The other sections of the adhesive yarn, in particular the stitch shanks and stitch feet lie in the interior of the knitted fabric. Consequently only a very small amount of adhesive yarn appears on the surface on the respective side of the knitted fabric.

A further disadvantage of the textile fabric known from the prior art is the lack of connection between the adhesive sections of one side, in particular the inner side of the fabric, and the adhesive sections of the other side, in particular the outer side of the fabric. The opposite adhesive sections are not connected directly to one another so that the opposite adhesive sections can be displaced with respect to one another under stress by the wearer, in particular due to the production of shear forces. A secure hold in the stocking cannot be ensured.

It is therefore the object of the present invention to provide an, in particular compressive, knitted fabric which avoids the disadvantages from the prior art, in particular significantly improves the adhesive effect of the knitted fabric. Preferably the hold of the knitted fabric on the wearer should be improved whilst simultaneously increasing the adhesive effect with respect to an external surface.

According to one exemplary embodiment of the compressive knitted fabric, this consists of at least one stitch-forming basic knitting thread, at least one inserted and/or knitted elastic weft thread and at least one plush thread plaited, at least partially, onto the basic knitting thread and forming plush loops, wherein the at least one plush thread is an adhesive thread in order to give the compressive knitted fabric an anti-slip effect. The at least one stitch-forming basic knitting thread and the at least one inserted and/or knitted elastic weft thread are knitted to form a basic knitted fabric.

The adhesive thread preferably comprises a silicone, elastane or rubber thread. In this case, the adhesive thread particularly preferably comprises a thread core, preferably made of elastane or polyamide, wherein the thread core is coated or wrapped with silicone, elastane and/or rubber. For better knittability, the thread is further preferably provided with a fluid-soluble, in particular water-soluble coating or is wrapped with a fluid-soluble, in particular water-soluble, wrapping thread. Such an wrapping thread or coating reduces the friction of the otherwise adhering silicone material during the knitting process, in particular on the stitch-forming elements (needles, thread guides etc.) and the thread supply. After the knitting, the knitted fabric is preferably washed so that the water-soluble wrapping thread or the coating dissolves and the adhesive properties of the silicone thread or silicone coating are fully effective.

According to a second exemplary embodiment, a second plush thread, preferably made of polyamide, polyester, polypropylene or natural fibre, is plaited, at least partially, onto the basic knitting thread and forming plush loops. By this means, in addition to an adhesive effect, the knitted fabric is also imparted a cushioning property. Particularly preferably, the first plush loops formed by the adhesive thread and the second plush loops formed by the second plush thread are of different heights. In this case, the sections with the plush threads forming plush loops preferably at least partially overlap so that a multilayer structure is formed. The basic knitting thread knitted in a stitch-forming manner hereby forms a first layer or basic knitted-fabric plane. A second layer or first plush plane, in particular for cushioning is formed by the plush threads forming plush loops. A third layer, in particular adhesive layer, is formed by the adhesive threads forming plush loops, wherein the plush loops of the adhesive thread are longer than those of the second plush thread.

According to a third exemplary embodiment, the plush loops formed by the adhesive threads extend through the basic knitted fabric so that the adhesive thread emerges on both sides of the knitted fabric. Thus, the stitch heads and stitch feet are preferably exposed on one knitted fabric side and the appurtenant stitch shanks on the other knitted fabric side. Depending on the setting of the knitting machine, the plush loops formed by the stitch heads and parts of the stitch shanks are formed of different heights.

According to a further exemplary embodiment, the adhesive thread for forming one or more anti-slip elements is introduced into the basic knitted fabric in a locally limited manner. Preferably the one or the plurality of anti-slip elements each have an extension between 1 and 2 cm, but at most 3 cm, in the knitted fabric longitudinal and/or circumferential direction. In this case, the adhesive thread is knitted in the circumferential direction preferably only partially to form a plush loop within a row of stitches. Alternatively the adhesive thread can be knitted into the basic knitted fabric in sections. Then the adhesive thread is knitted-in in the at least one section preferably forming plush loops in some regions and in some regions is only deposited or plaited-on in the basic knitted fabric without forming plush loops to form a plurality of adjacently arranged anti-slip elements.

The compressive knitted fabric according to the previous exemplary embodiment is preferably configured as a stocking, in particular an arm or leg stocking, a sock, legging, sleeve, legging or hose, a bandage, or a knitted part of an orthesis. Particularly preferably it is configured as a compressive knitted fabric wherein the compression strength in the knitted fabric longitudinal direction decreases or increases from the ankle in the direction of the calf muscles.

In the configuration of the knitted fabric as a leg garment, in particular as a leg stocking, sock or foot bandage, the at least one adhesive thread forming the plush loop is knitted into the knitted fabric in such a manner that the plush loops in the worn state of the knitted fabric are arranged in the area of the sole of the foot, in particular only in the area of the heel, toe and/or the ball of the foot on the inner and/or outer side of the knitted fabric.

In the case of a compressive leg garment, the compressive pressures produced by the knitted fabric in an ankle region of the leg garment are preferably between 10 and 40 mmHg, in the calf region are between and 30 mmHg and in a midfoot region preferably between 10 and 30 mmHg.

The present leg garment is characterized by a series of considerable advantages.

The adhesive property of the knitted fabric is increased substantially due to the configuration of the compressive knitted fabric with a plush thread, which is an adhesive thread, forming at least in sections a plush loop plaited onto a basic knitted thread. The configuration of plush loops which consist of the stick heads and large parts of the stitch shanks, with an adhesive thread has the result that substantially more anti-slip and/or adhesive material is arranged above the basic knitted fabric surface than is known from the prior art so that the knitted fabric is imparted a substantially better anti-slip effect.

By knitting in the adhesive thread in such a manner that the plush loops formed by the adhesive thread extend through the basic knitted fabric, it is further achieved that the adhesive sections are formed on both sides of the knitted fabric which are directly connected to one another, i.e. formed in one piece and extend through the knitted fabric so that when loaded by the wearer, the opposite adhesive sections transmit the applied shear forces directly without the opposite adhesive sections being displaced with respect to one another with the result that any slippages of the wearer with respect to the knitted fabric can be completely avoided, which also offers a substantial advantage.

The cost-effective manufacture of one or more anti-slip sections, in particular on two opposite surfaces of a knitted part, forms a further advantage of the invention. One or more adhesive sections, but also opposite adhesive sections on the knitted fabric can be produced by means of preferably a single process step, namely knitting in a single adhesive thread. The complex knitting-in of several adhesive threads and/or application of adhesive material via templates etc. is no longer necessary.

In addition, as a result of the configuration according to the invention of the one or several adhesive sections, in particular due to the manner in which the adhesive thread is incorporated into the basic knitted fabric, it is possible that the predominant part of the adhesive thread, namely the stitch heads and stitch feet formed by the thread and also large parts of the stitch shank, is arranged freely accessibly on the inner side of the knitted fabric or outer side of the knitted fabric. This has the result that substantially more anti-slip material is arranged on the knitted fabric surface. At the same time, compared to the prior art, substantially less material is located in the interior of the knitted fabric so that any increased formation of perspiration of the wearer of the garment as a result of reduced breathability of the knitted fabric can be avoided.

Also compared to the application of external adhesive material to the knitted fabric, in particular in liquid form, the possibility of arranging adhesive sections on the knitted fabric with stitch accuracy, i.e. by partially forming at least one plush loop within a stitch row, which can also be placed individually with stitch accuracy on the knitted fabric is a substantial advantage.

The invention will be explained hereinafter with reference to several exemplary embodiments and combined with the drawings.

DETAILED DESCRIPTION OF THE DRAWINGS

Figure 2:
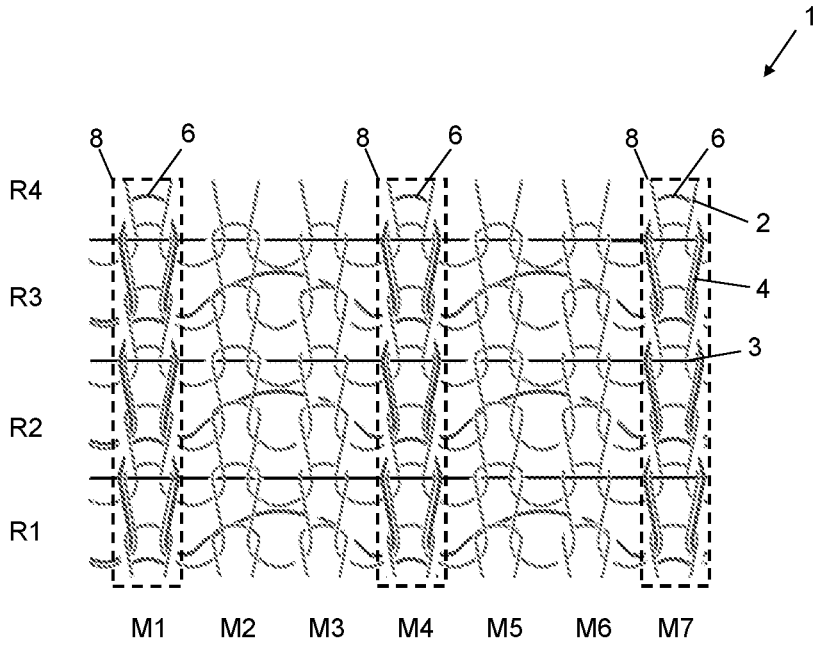
Figure 3:
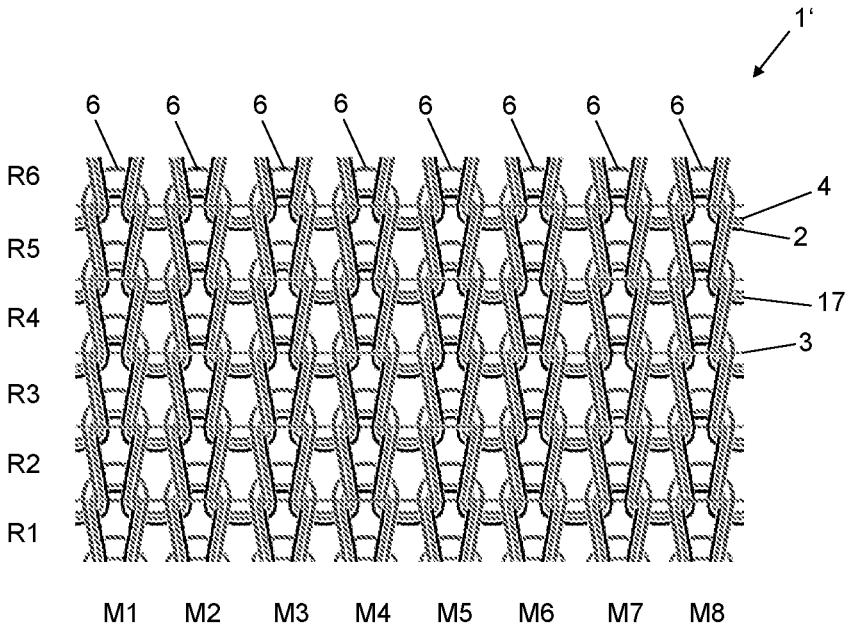
Figure 4:
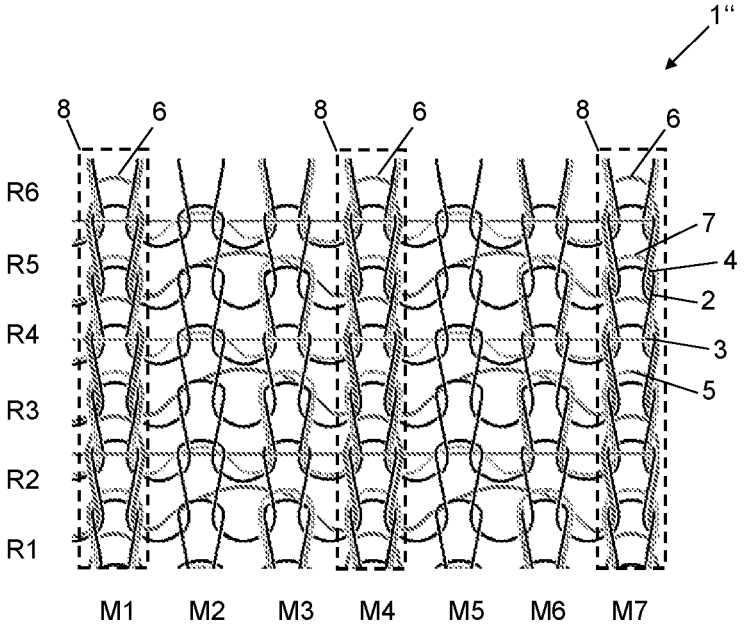

In the figures:

FIG. 1 shows an exemplary embodiment of a stocking consisting of a compressive knitted fabric according to the invention in side view, FIG. 2 shows a stitch pattern of an exemplary embodiment of the compressive knitted fabric, FIG. 3 shows a stitch pattern of the first section from the leg stocking from FIG. 1, FIG. 4 shows a stitch pattern of the second section from the leg stocking from FIG. 1;

DETAILED DESCRIPTION OF THE INVENTION

FIG. 1 shows an exemplary embodiment of a stocking 9, consisting of a compressive knitted fabric according to the invention in side view. The stocking 9, in particular sports stocking, consists of at least one first and second knitted fabric section 18, 19, preferably knitted by means of a circular knitting machine. At the upper end of the first section 18, i.e. the leg part, the stocking 9 preferably has a waistband 20. The compressive pressures produced by the stocking are preferably between 10 and 40 mmHg in an ankle region 14 of the leg garment, between 5 and 30 mmHg in the calf region 15 and between 10 and 30 mmHg in a midfoot region 16. The values are measured by means of the initially presented measurement method and measuring device, in particular by means of testing on the HOSY measuring device (Hohenstein Institute). On the inner side the stocking 9 has a first cushioning 21 which, when viewed in the circumferential direction, preferably only extends between the two muscle heads of the calf muscles without overlapping these. Furthermore, the at least one cushioning 21 in the worn state of the stocking 9 additionally extends at least partially along the Achilles tendon in the direction of the heel 11. Furthermore, the stocking 9 has second knitted section, i.e. the foot part 19. This foot part 19 preferably comprises a further cushioning 22 for the toe region 12, the balls of the foot 13, the heel 11 and the sole of the foot 10. In this exemplary embodiment, the cushioning 22 extends from the sole 10 into the sides of the foot part 19. The cushioning 22 can also be arranged only in individual section of the aforesaid regions. In this exemplary embodiment, the plurality of cushionings 21 and 22 are formed by a knitted section in the knitted fabric which differs from a region of the basic knitted fabric adjacent to the cushioning 21, 22 with regard to its type of binding. Here the plurality of cushionings 21, 22 are preferably formed as a plush, in particular sandwich plush.

In the exemplary embodiment shown, the stocking 9 has a gradual compression profile in the longitudinal direction of the knitted fabric. In this case, the compression strength decreases from the lower end in the direction of the calf muscles. The gradual pressure profile is determined by the manner of introducing a weft thread 3, in particular by means of the number of successive stitch rows in which the weft thread 3 is inserted. Alternatively it is also possible that the knitted fabric according to the invention is formed as an arm stocking, sock, bandage or a knitted part of an orthesis.

In order to ensure a secure hold of the stocking 9 on the leg of the wearer but also, inter alia, to give the stocking 9 an anti-slip effect with respect to external surfaces, according to the invention an adhesive thread is knitted into the compressive knitted fabric according to the invention. The adhesive thread is in this case plaited onto at least one basic knitted thread forming plush loops at least in sections. The plush loops thereby formed or the so-called adhesive plush form a further knitted fabric plane above the basic knitted fabric on the inner and/or outer side of the compressive knitted fabric. The adhesive plush has an increased coefficient of friction compared with the remaining knitted fabric. The adhesive thread preferably comprises a silicone thread or a thread which also has an adhesive, preferably slightly sticky, adhesive, in any case anti-slip surface. An adhesive layer is thus applied to the knitted fabric or in this exemplary embodiment the leg stocking 9, partially, i.e. in sections on the inner and/or outer side. Particularly preferably these are located, according to this first exemplary embodiment, on the inner side in the area of the band 20 and on the inner and outer side in the sole of the foot region 10. Anti-slip elements 8 are thus formed. The manner in which the adhesive thread is incorporated into the basic knitted fabric in these regions according to this exemplary embodiment of the leg stocking 9 is shown in the stitch patterns according to FIGS. 2 to 4 and described as follows. Firstly in FIG. 2 a first simple configuration of the compressive knitted fabric 1 according to the invention in the form of a stitch pattern is explained in detail.

The stitch pattern according to FIG. 2 shows a compressive knitted fabric 1 consisting of a basic knitting thread 2 which is knitted forming stitches over several knitting rows R1 to R4 and stitch wales Ml to M7. At least one compression-giving weft thread 3 is inserted into the basic knitting stitches. In this exemplary embodiment, the highly elastic weft thread 3 is inserted in every other stitch row. However, this can be configured arbitrarily. This weft thread can also be inserted in every stitch row or in every n-th stitch row. Furthermore, when viewed in the circumferential direction, the weft thread 3 can also be knitted in one or more stitch wales forming stitches, also in sections.

In addition to the basic knitting thread 2 and the weft thread 3, the stitch pattern shows an adhesive thread 4 forming plush loops plaited onto the basic knitting thread 2 at least in sections. According to this exemplary embodiment, this is present in each stitch row. This thread 4 can also be knitted into the knitted fabric 1 only in any arbitrary stitch row and only in sections, i.e. partially and not circumferentially, when viewed in the circumferential direction. In the stitch pattern the adhesive thread 4 is shown next to the basic knitting thread 2 but this is only for purposes of illustration. According to the knitting insertion, i.e. due to the plaiting of the adhesive thread 4 onto the basic knitting thread 2, the adhesive thread 4 is located substantially in front of or behind the basic knitting thread 2, in a plan view of the knitted fabric 1. The threads 2, 4 therefore lie substantially, i.e. for the most part above or behind one another in the knitted fabric 1.

According to this exemplary embodiment, the adhesive thread 4 in each case forms plush loops 6 in a first stitch wale, is then merely deposited in two further stitch wales and again forms plush loops 6 in the following stitch wale. As a result of this knitting insertion, so-called anti-slip elements 8, in the form of rods or ribs are produced which emerge on the inner side and/or outer side of the basic knitted fabric 1. Anti-slip elements 8 are formed by these ribs 8 or plush ribs 8 formed from one or more adhesive threads 4. In addition to a rib-shaped configuration, naturally other geometrical shapes such as, for example, punctuate or circular configurations of the anti-slip elements 8 are possible. Particularly preferably these each have an extension in the knitted-fabric longitudinal and/or circumferential direction between 1 and 2 cm, at most 3 cm.

According to this first exemplary embodiment, the stitch heads and stitch feet as well as large parts of the stitch shank of the adhesive thread 4 are preferably each facing the skin of the wearer. On the opposite side of the knitted fabric, i.e. the side facing away from the wearer, only parts of the stitch shanks emerge. Moreover, each stitch of the plurality of stitches formed by the adhesive thread form a segment of the adhesive thread. Wherein in each stitch, the first one of the two stitch feet is formed by a first portion of the segment, the first one of the two stitch shanks is formed by a second portion of the segment, the stitch head is formed by a third portion of the segment, the second one of the two stitch shanks is formed by a fourth portion of the segment, the second one of the two stitch feet is formed by a fifth portion of the segment, wherein the first portion and the second portion are adjacent and continuous, the second portion and the third portion are adjacent and continuous, the third portion and the fourth portion are adjacent and continuous, and the fourth portion and the fifth portion are adjacent and continuous. The plush loops 6 formed by adhesive thread 4 therefore preferably extend through the basic knitted fabric 1 so that the adhesive thread 4 emerges on both sides of the knitted fabric 1 and forms anti-slip elements 8. The knitted fabric 1 thus ensures a secure hold with respect to the wearer and also an external surface.

A stitch pattern, in particular a first section A from the exemplary embodiment of the leg stocking 9 shown in FIG. 1, in particular in the region of the waistband 20, is shown in FIG. 3. The stitch pattern also shows, as in FIG. 2, a stitch-forming basic knitting thread 2 which is knitted over several knitting rows R1 to R6 and stitch wales M1 to M8 to form the band 20. At least one compression-giving weft thread 3 is inserted in the basic knitted fabric 1'. The weft thread 3 is here inserted in each stitch row. In addition to the basic knitting thread 2 and the weft thread 3, the stitch pattern also shows a reinforcing thread 17 plaited onto the basic knitting thread. According to the exemplary embodiment, this is present in each stitch row and each stitch wale. This thread 17 can also be knitted into the knitted fabric only in each arbitrary stitch row and only in sections when viewed in the circumferential direction. As already explained previously, the reinforcing thread 17 is shown next to the basic knitting thread 2 but this is only for the purpose of illustration. This thread 17 is also located substantially in front of or behind the basic knitting thread 2. Particularly preferably the reinforcing thread 17 is plaited onto the basic knitting thread 2 in the entire knitted fabric of the leg stocking 9 shown in FIG. 1. The reinforcing thread 17 here consists of a plurality of profile fibres spun together in order to form channels for transporting moisture between the plurality of fibres. Moisture can thus be removed effectively from the basic knitting thread 2.

In addition to the basic knitting, reinforcing and weft thread 2, 17, 3, an adhesive thread 4 is additionally provided. This is knitted into the basic knitted fabric 1' in such a manner that it forms plush loops 6 in each basic knitting stitch formed. As a result of this knitting insertion, a flat adhesive section is formed which produces a particularly high adhesive effect as a result of the plurality of plush loops 6 and therefore adhesive material on the surface of the knitted pattern 1'. The amount of adhesive material can be additionally increased by the formation of very long plush loops 6, by the use of suitable sinkers in the knitting machine. A particularly good hold of the stocking 9 according to FIG. 1 on the wearer is thus ensured.

FIG. 4 now shows a second section B from the leg stocking 9 shown in FIG. 1, in particular in the region of the sole 10. The stitch pattern shows, as in the figures previously, a stitch-forming basic knitting thread 2 which is knitted over several knitting rows R1 to R6 and stitch wales M1 to M7. At least one compression-giving weft thread 3 is inserted in the basic knitted fabric 1" in every other stitch row.

In order to form a cushioning 22 in the sole region 10, the knitted fabric 1" now additionally has, at least in sections, a plush thread 5 forming a second plush loop. This preferably consists of polyamide, polyester, polypropylene or natural fibre. As a result, the knitted fabric 1" has a cushioning property. The plush thread 5 in this exemplary embodiment forms plush loops 7 in two adjacent stitch wales and is merely deposited in the respectively adjacent stitch wale in each case. A plurality of knitting variants are feasible.

In addition to the basic knitting, weft and plush threads 2, 3, 5, the knitted fabric 1" also has an adhesive thread 4 in the sole region 10. This is knitted into the basic knitted fabric 1" in such a manner that it forms plush loops 6 in a stitch wale and is only deposited in the respectively two adjacent stitch walls. By this means, as already described in FIG. 2, rib-shaped anti-slip elements 8 are formed on the inner and outer side of the knitted fabric 1". Furthermore, the sections with the plush threads 4, 5 forming plush loops overlap so that a multilayer structure is formed. As can be deduced from the stitch pattern, the plush loops 6 formed by the adhesive thread 4 and the plush loops 7 formed by the second plush threads 5 are preferably formed of different heights. The basic knitting thread 2 knitted in a stitch-forming manner here forms a basic knitted fabric plane. A plush plane, in particular for cushioning, is formed by the plush threads 5 forming plush loops. A third layer, in particular adhesive layer in rib form, is formed by the adhesive threads 4 forming the plush loops. This is accomplished by forming the plush loops 6 of the adhesive thread 4 longer than those of the second plush thread 5. As a result of this configuration of the knitted part, the knitted part, in particular the leg stocking 9 is ensured a secure hold with respect to the stocking 9 and at the same time with respect to an external surface in addition to an increased wearing comfort due to a cushioning in the sole region 10. This is accomplished by the stitch-precise knitting-in or placement of cushioning and anti-slip elements 8.

In summary, it should be noted once again that the adhesive thread can be knitted into the knitted fabric to form plush loops by various knitting methods, as shown in the previous stitch patterns, in various manners. Furthermore, the knitting insertion, as also illustrated, can vary in sections within a garment in order to match the adhesive effect individually to the respective requirement. Areas of a leg garment in which an adhesive thread is particularly preferably knitted in and therefore have an adhesive or anti-slip effect are in particular the waistband, the calf, or the sole of the foot. Other sections are feasible and can easily be implemented according to the invention.

The invention is not restricted to the exemplary embodiments described but comprises all embodiments which apply or include the fundamental appropriate functional principle of the invention. Furthermore, all the features of all the exemplary embodiments described and depicted can be combined with one another.

The invention claimed is:

1. A compressive knitted fabric comprising:

at least one stitch-forming basic knitting thread;

at least one inserted and/or knitted elastic weft thread; and at least one adhesive thread plaited, at least partially, onto the basic knitting thread and forming plush loops, wherein the at least one adhesive thread gives the compressive knitted fabric an anti-slip effect, wherein the at least one stitch-forming basic knitting thread and the at least one inserted and/or knitted elastic weft thread are knitted to form a basic knitted fabric, wherein the at least one adhesive thread forms a plurality of stitches, each stitch of the plurality of stitches forming a segment of the at least one adhesive thread and having a stitch head, two stitch feet and two stitch shanks, wherein the first one of the two stitch feet is formed by a first portion of the segment, the first one of the two stitch shanks is formed by a second portion of the segment, the stitch head is formed by a third portion of the segment, the second one of the two stitch shanks is formed by a fourth portion of the segment, the second one of the two stitch feet is formed by a fifth portion of the segment, wherein the first portion and the second portion are adjacent and continuous, the second portion and the third portion are adjacent and continuous, the third portion and the fourth portion are adjacent and continuous, and the fourth portion and the fifth portion are adjacent and continuous, and wherein for each stitch, the stitch head and the two stitch feet are exposed on a first side of the basic knitted fabric and the two stitch shanks are exposed on a second side of the basic knitted fabric, the first side and the second side being opposite sides of the basic knitted fabric, wherein each stitch head formed by the at least one adhesive thread extends beyond the basic knitted fabric and is positioned in front of the basic knitting thread on the first side, and each stitch shank formed by the at least one adhesive thread extend beyond the basic knitted fabric and are positioned in front of the basic knitting thread on the second side.

2. The compressive knitted fabric according to claim 1, wherein the at least one adhesive thread is a silicone, elastane or rubber thread.

3. The compressive knitted fabric according to claim 1, wherein the at least one adhesive thread has a thread core made of elastane, wherein the thread core is coated or wrapped with silicone, elastane and/or rubber.

4. The compressive knitted fabric according to claim 1, wherein the at least one adhesive thread is provided with a water-soluble coating or is wrapped with a water-soluble wrapping thread.

5. The compressive knitted fabric according to claim 1, further comprising at least one plush thread made of polyamide, polyester, polypropylene or natural fibre, the at least one plush thread is plaited, at least partially, onto the basic knitting thread and forming plush loops.

6. The compressive knitted fabric according to claim 5, wherein the plush loops formed by the at least one adhesive thread and the plush loops formed by the at least one plush thread are of different heights.

7. The compressive knitted fabric according to claim 5, wherein sections with the at least one adhesive thread forming plush loops and sections with the at least one plush thread forming plush loops at least partially overlap.

8. The compressive knitted fabric according to claim 1, wherein the plush loops formed by the at least one adhesive thread extend through the basic knitted fabric so that the at least one adhesive thread emerges on both sides of the knitted fabric.

9. The compressive knitted fabric according to claim 1, wherein the at least one adhesive thread forms one or more anti-slip elements and is introduced into the basic knitted fabric only at certain locations on the basic knitted fabric.

10. The compressive knitted fabric according to claim 9, wherein the one or more anti-slip elements each has an extension between 1 and 2 cm in the knitted fabric longitudinal and/or circumferential direction.

11. The compressive knitted fabric according to claim 9, wherein the one or more anti-slip elements each has an extension between 2 and 3 cm in the knitted fabric longitudinal and/or circumferential direction.

12. The compressive knitted fabric according to claim 1, wherein the at least one adhesive thread is knitted into the basic knitted fabric in the circumferential direction partially or in sections to form at least one plush loop of the plush loops.

13. The compressive knitted fabric according to claim 12, wherein the at least one adhesive thread is knitted-in in at least one section in such a way forming plush loops in some regions and in some regions only deposited into or plaited on the basic knitted fabric without forming plush loops to form a plurality of adjacently arranged elements with the anti-slip effect.

14. The compressive knitted fabric according to claim 1, wherein the basic knitted fabric is an arm or leg stocking, a sock, a bandage, a foot bandage, or a knitted part of an orthesis.

15. The compressive knitted fabric according to claim 14, wherein the at least one adhesive thread is knitted into the compressive knitted fabric formed as the leg stocking, sock or foot bandage in such a manner that the plush loops in the worn state of the compressive knitted fabric are arranged in the area of the sole of the foot only in the area of the heel, toe and/or balls of the foot, on the first side and/or the second of the knitted fabric.

16. The compressive knitted fabric according to claim 14, wherein compressive pressures produced by the basic knitted fabric in an ankle region of the leg stocking are between 10 and 40 mmHg, in the calf region are between 5 and 30 mmHg and in a midfoot region are between 10 and 30 mmHg.

* * * * *